US009885512B2

(12) United States Patent
Sustic

(10) Patent No.: US 9,885,512 B2
(45) Date of Patent: Feb. 6, 2018

(54) APPARATUS AND METHOD FOR REGULATING AIR FLOW TO A GARNISH IN A COOLER

(71) Applicant: Anthony Sustic, Ridgeway (CA)

(72) Inventor: Anthony Sustic, Ridgeway (CA)

( * ) Notice: Subject to any disclaimer, the term of this patent is extended or adjusted under 35 U.S.C. 154(b) by 659 days.

(21) Appl. No.: 14/447,826

(22) Filed: Jul. 31, 2014

(65) Prior Publication Data

US 2016/0033191 A1 Feb. 4, 2016

(51) Int. Cl.

| | |
|---|---|
| ***F25B 17/02*** | (2006.01) |
| ***F25D 17/06*** | (2006.01) |
| *F25D 23/02* | (2006.01) |

(52) U.S. Cl.

CPC ..... *F25D 17/06* (2013.01); *F25D 23/026* (2013.01); *F25D 2317/063* (2013.01); *F25D 2317/0665* (2013.01)

(58) Field of Classification Search

CPC .. F25D 17/06; F25D 23/026; F25D 2317/061; F25D 2317/063; F25D 2317/0665; F24F 13/08; F24F 2013/1473

See application file for complete search history.

(56) References Cited

U.S. PATENT DOCUMENTS

| | | | | |
|---|---|---|---|---|
| 4,480,533 | A | 11/1984 | Bolton et al. | |
| 5,740,641 | A * | 4/1998 | Oxnard | E04H 5/02 160/201 |
| 6,904,761 | B2 | 6/2005 | Rafalovich et al. | |
| 7,004,832 | B2 | 2/2006 | Thomas | |
| 7,272,949 | B2 | 9/2007 | Lee et al. | |
| 2005/0061018 | A1 * | 3/2005 | Kim | F25C 5/005 62/344 |

* cited by examiner

*Primary Examiner* — Justin Jonaitis
*Assistant Examiner* — Nael Babaa
(74) *Attorney, Agent, or Firm* — Vincent G. LoTempio; Kloss, Stenger & LoTempio; David T. Stephenson

(57) ABSTRACT

An apparatus selectively distributes air flow through a cooler to maintain cool air over garnish in the cooler. A cooler cavity includes a lower region where the air is generated, and an upper region where a cooler lid performs the dual purpose job of regulating access to the garnish and controlling a vent for directional air flow throughout the cooler. A container of garnish rests between the upper and lower regions. A vent positions adjacently to the container. A fulcrum extends from the vent. A force, such as the cooler lid, presses down on one end of the vent to tilt the vent between the closed and the open positions. The container and the vent form a barrier between the upper and lower regions from the closed position. The vent guides air flow from the lower to the upper region, and over the garnish from the open position.

10 Claims, 5 Drawing Sheets

APPARATUS AND METHOD FOR REGULATING AIR FLOW TO A GARNISH IN A COOLER

FIELD OF THE INVENTION

The present invention relates generally to an apparatus and method that selectively distributes air flow above and below a garnish stored in a cooler. More so, the apparatus and method manipulates the positioning of a vent through the opening and closing of a cooler lid to regulate the distribution of air flow in the cooler.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon.

By way of educational background, another aspect of the prior art generally useful to be aware of is that a garnish is an item or substance used as a decoration or embellishment accompanying a prepared food dish or drink. In many cases, the garnish may give added or contrasting flavor. Some garnishes are selected mainly to augment the visual impact of a cocktail, while others are selected specifically for the flavor they may impart In a bar setting, the garnish can include olives, lemons, limes, mint leaves, and other embellishments for drinks. These garnishes require a cool temperature to remain fresh and aesthetically pleasing. Typically, these garnishes are stored in a small horizontal container with individual compartments which fit behind the bar. These containers remain at room temperature unless a method of cooling is applied. Though many other types of coolers can be used, such as a thermoelectric cooler, an ice chest, a freezer, and a refrigerator. The cool air is generated by a refrigeration module having a fan that blows the cool air upwardly towards the targeted items.

Often, a compartmentalized garnish container is used to hold the garnishes. The garnish container is often left unrefrigerated due to need of constant access to the garnishes. The garnish container may be left within a larger beer cooler but this creates constant accessibility issues while making cocktails. Items in the larger cooler, such as vents, glasses, bottles, and foods tend to restrict air flow in the cooler. This is especially problematic when the cooler door is closed and the ambient air cannot circulate over the garnishes.

Typically, after the bar closes, the garnishes must be transported to a larger cooler for overnight storage so that air circulation is maintained over the garnishes. Without this fresh air, the garnishes would become discolored and lose flavor and have a considerably shorter life span. This transport often requires several trips across a bar, to the kitchen area. During opening of the bar, the trip must be repeated as the garnish container is moved from the larger cooler to the bar area. This is a time consuming process that can also lead to spillage and accidents and is often forgotten completely, resulting in the garnishes to be left unrefrigerated overnight.

Even though the above cited methods for storing garnishes in a cooler address some of the needs of the market, an apparatus for the overnight storage and constant cooling of the garnishes is still desired, as well as a method to that regulates air flow over or under the garnish when the cooler door is closed and not in use.

SUMMARY OF THE INVENTION

The present invention is directed to an apparatus and method for maintaining freshness, crispness, and coolness for a garnish stored inside a cooler. The apparatus and method creates air flow above and below the garnish, and maintains a desired temperature and atmosphere for the garnish inside the cooler. The directional movement of the air flow over the garnish is regulated by a vent. The vent position is dependent on whether a cooler lid is open or closed. Specifically, the apparatus and method selectively circulates fresh air flow above and below the garnish when the cooler lid is closed, and circulates fresh air flow below the garnish when the cooler lid is open. In this manner, the garnish can be maintained at a desired temperature and humidity overnight in the cooler without requiring transfer to a secondary cooler. The integrity and quality of the garnish is also enhanced through selective regulation of the air flow over the garnish.

The cooler is configured to store and maintain a desired air flow, temperature, and humidity for a variety of garnishes stored within a cooler cavity. The cooler cavity includes a lower region where the cool air is generated through a cooling mechanism, and an upper region where a cooler lid performs the dual purpose job of regulating access to the garnish and controlling a vent for directional air flow throughout the cooler. A container for containing the garnish rests between the upper and lower regions, generally more proximal to the upper region. In this manner, the cool air generated in the lower region has greater volume to expand beneath the container. A vent positions adjacently to the container, abutting the container. A cooler bracket is arranged around the periphery of the upper region, forming a structural support for the container and the vent to rest.

The vent is configured to enable the cool air to communicate between the upper and lower regions of the cooler. A fulcrum extends from the vent. A force, such as the cooler lid, can then press down on one end of the vent to allow for a tilting movement between a natural closed position, and an upwardly oriented open position. Both the container and the vent form a barrier between the upper and lower regions of the cooler when the vent is in the closed position. However, when the cooler lid closes and presses down on one end of the vent, the vent tilts on the fulcrum to the open position. From this open position, the vent guides the cool air to flow over the garnish in the adjacent container.

One objective of the present invention is to store the garnish at a cool temperature with a fresh air flow engaging the garnish overnight during storage.

Another objective is to provide a cost effective mechanism for circulating fresh air over a garnish during overnight storage.

Another objective is to eliminate the need to move garnishes to a different cooler for overnight storage.

Yet another objective is to reduce waste by prolonging the quality of the garnishes.

Yet another objective is to provide an apparatus and method that more efficiently regulates the temperature, humidity, and atmosphere in a cooler.

Yet another objective is to manipulate a vent between an open position and a closed position through manual effort of opening and closing a cooler lid, rather than electrical actuation of the vent.

Yet another objective is to provide an apparatus and method for cooling a garnish that can be retrofit onto any standard cooler, including a horizontal cooler, a chiller, a refrigerator, a portable ice chest, an ice box, and a cool box.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which:

FIG. 6A illustrates the vent and the cooler bracket separated, FIG. 6B illustrates the vent in the open position relative to the cooler bracket, and FIG. 6C illustrates the vent in the closed position relative to the cooler bracket, in accordance with an embodiment of the present invention.

Like reference numerals refer to like parts throughout the various views of the drawings.

DETAILED DESCRIPTION OF THE INVENTION

Figure 1:
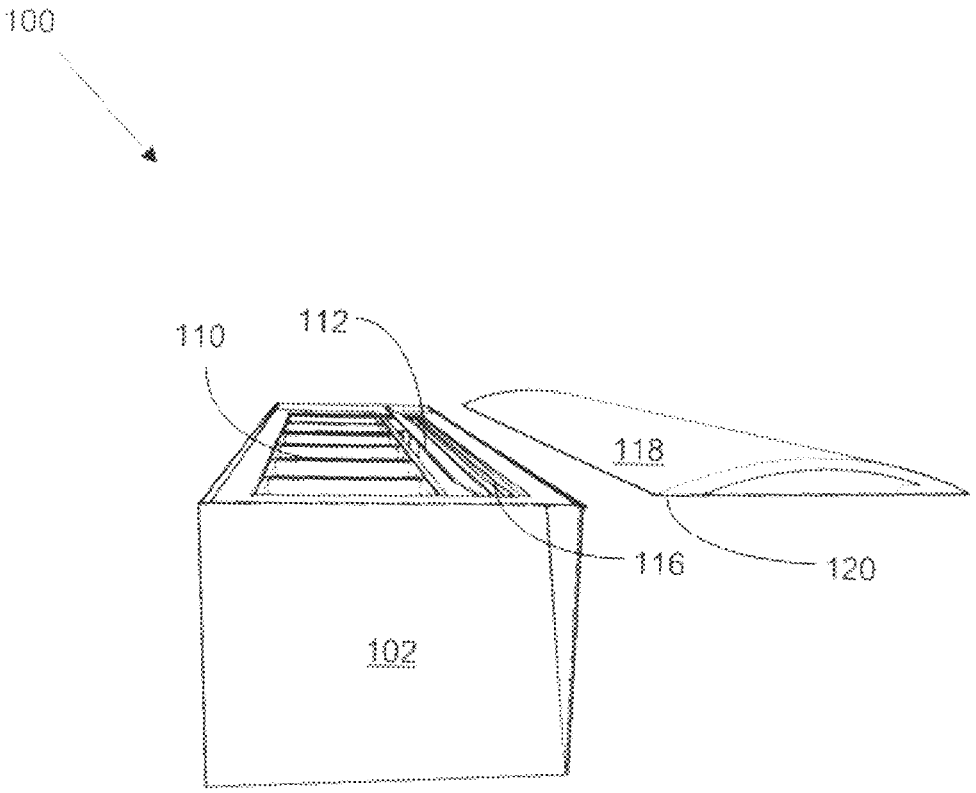
FIG. 1 illustrates a detailed perspective view of an exemplary apparatus joined with an exemplary cooler, and an exemplary cooler lid, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1-7, an apparatus 100 and method 200 selectively distributes air flow through a cooler 102 to maintain freshness, crispness, and coolness for a garnish (not shown) stored in the cooler 102. The apparatus 100 and method 200 regulates distribution of the air flow between an upper region 106 and a lower region 108 of a cooler cavity 104 to maintain a predetermined temperature and atmosphere for the garnish. The directional movement of the air flow is dependent on whether a cooler lid 118 is open or closed relative to the cooler 102. Specifically, the apparatus 100 and method 200 selectively circulates the air flow above and below the garnish when the cooler lid 118 is closed, and circulates fresh air flow below the garnish when the cooler lid 118 is open.

As referenced in FIG. 1, an apparatus 100 comprises a container 110 and a vent 112 that coordinate air flow communication within a cooler cavity 104. In one embodiment, the cooler 102 may include a horizontal cooler that maintains a temperature of about 40° Fahrenheit, which is efficacious for storing and preserving garnishes for long durations. In another embodiment, the cooler 102 generates air flow, in the form of cold air, with a cooling mechanism 124, such as a Peltier thermoelectric module. However in other embodiments, any refrigerant known in the art may be used to generate the cool air. A fan 122 blows the cool air to generate the air flow.

Figure 2:
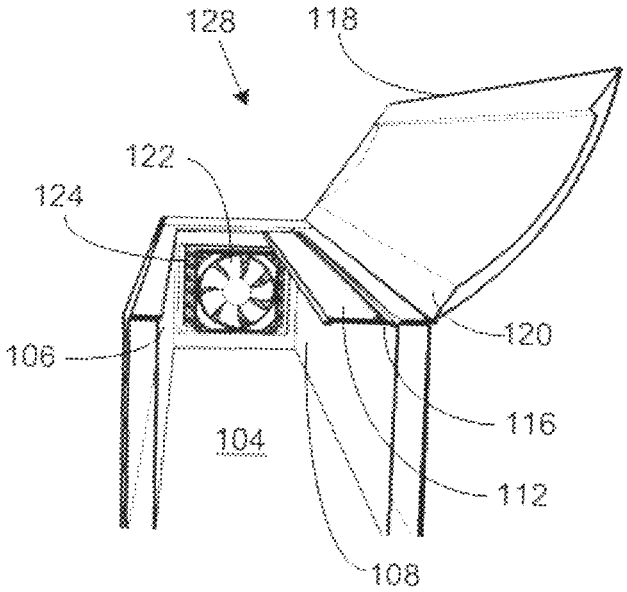
FIG. 2 illustrates a detailed perspective view of an exemplary vent in a closed position and the cooler lid opened, in accordance with an embodiment of the present invention.

FIG. 2 illustrates the cooling mechanism 124 resides in the lower region 108 such that the genesis of the air flow is in the lower region 108. A fan 122 maintains a fresh circulation of the air flow in a cooler cavity 104. The fan 122, working in conjunction with the Peltier thermoelectric module, circulates the air flow from the lower region 108, beneath the container 110, to the upper region 106 for engagement with the garnish. In one alternative embodiment, a heat sink serves to dissipate heat into the environment for furthering the cooling affect in the cooler cavity 104.

Figure 3:
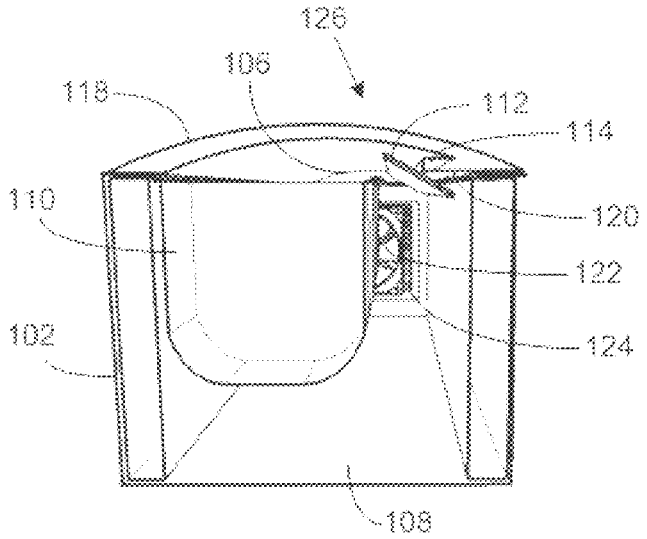
FIG. 3 illustrates a sectioned side view of an exemplary cooler with the vent in the open position and adjacent to an exemplary container, and the cooler lid closed, in accordance with an embodiment of the present invention.

FIG. 3 illustrates the container 110. The container 110 is configured to position inside the cooler cavity 104 while maintaining the garnish for display and distribution. The container 110 may include an elongated, compartmentalized garnish container configured to contain a plurality of garnishes. The container 110 extends along a longitudinal axis of the upper region 106 of the cooler cavity 104. In one embodiment, the container 110 sets proximally to an upper edge of the upper region 106, such that a greater volume in the cooler cavity 104 exists in the lower region 108. In some embodiments, each compartment in the container 110 can have a curved cavity sufficiently sized and dimensioned to contain the garnishes. The garnishes may include, without limitation, lemons, parsley, mint leaves, olives, cherries, and other fruits and vegetables that are generally cut into portions and used to provide flavor and decorations to drinks in the food and beverage industry.

Figure 4:
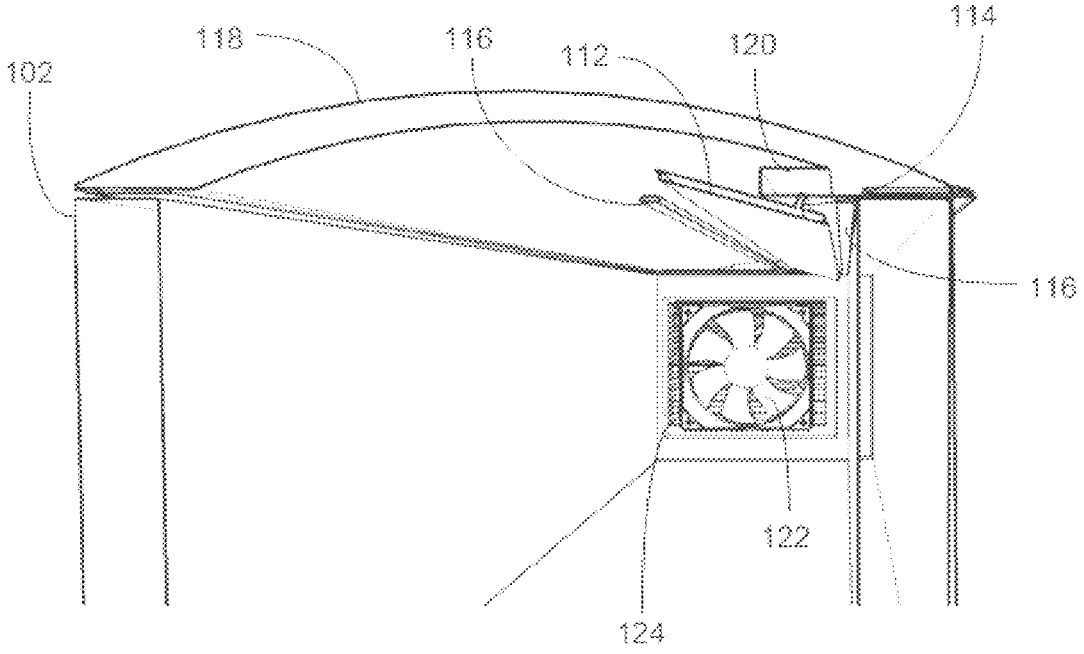
FIG. 4 illustrates a sectioned side view of an exemplary cooling mechanism and an exemplary fan generating air flow while the vent is in the open position, in accordance with an embodiment of the present invention.

In some embodiments, the vent 112 is arranged adjacently to the container 110. The vent 112 is positioned parallel and adjacent to the container 110. In one embodiment, the vent 112 and the container 110 abut each other, forming a restrictive barrier between the lower region 108 and the upper region 106 of the cooler cavity 104. However, the vent 112 can also be pivotally deployed through manipulation of the cooler lid 118 to enable passage of the air flow between the upper and lower regions 106, 108. The vent 112 comprises a generally elongated, planar shape that is disposed to extend along the longitudinal axis of the upper region 106. FIG. 4 illustrates the cooler lid 118 closed and the vent 112 in the open position 126. The air flow can circulate both above and below the container 110 while the cooler lid 118 is closed, such as for overnight storage.

Figure 5:
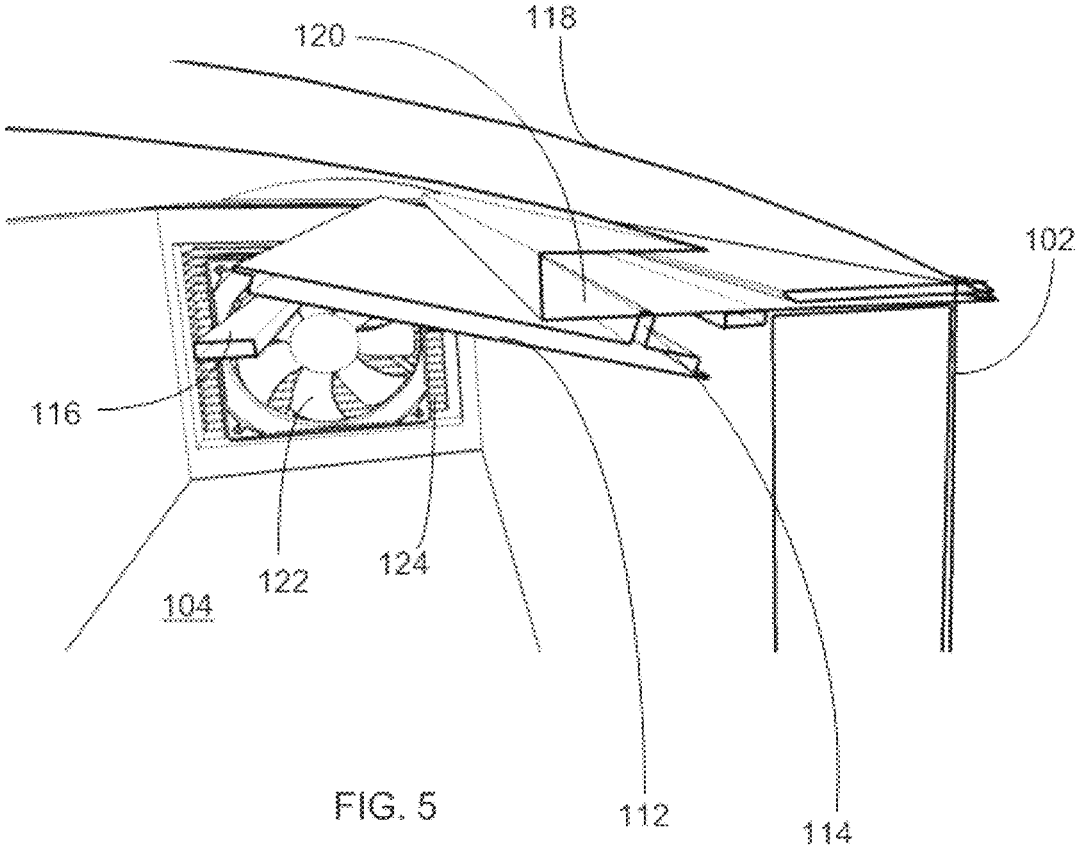
FIG. 5 illustrates a sectioned close-up view of the vent tilting to an open position off of a fulcrum while the hinge end of the cooler lid exerts a force on one end of the vent, in accordance with an embodiment of the present invention.

Turning now to FIG. 5, a fulcrum 114 extends from the vent 112. The fulcrum 114 enables the vent 112 to pivotally deploy between an open position 126 and a closed position 128 as force is applied to one end of the vent 112. The open position 126 enables the passage of air flow communication between the lower region 108 and the upper region 106 in the cooler cavity 104 (FIG. 4). The closed position 128 restricts air flow communication between the lower region 108 and an upper region 106 in the cooler cavity 104 (FIG. 2). The vent 112 abuts against the container 110 while in the closed position 128, such that the air flow is restricted between the lower region 108 and the upper region 106. In one alternative embodiment, the vent 112 could move between the open and closed positions 126,128 through other mechanisms, including an electric motor that slides the vent 112 between the open and closed positions 126,128, rather than tilting.

As referenced in FIG. 5, the cooler lid 118 closes in relation to the cooler 102 to force the vent 112 to the open position 126. FIG. 2 also shows how the cooler lid 118 opens in relation to the cooler 102 to release the vent 112 to the closed position 128. In some embodiments, the cooler lid 118 comprises a hinge end 120. The hinge end 120 is proximal to the cooler 102 while the cooler lid 118 is opened, and engages one end of the vent 112 while closed in relation to the cooler 102. This forcible engagement causes the vent 112 to pivot on the fulcrum 114 and thus, deploy to the open position 126. In this manner, the garnish can be maintained at a desired temperature and humidity overnight in the cooler 102 without requiring transfer to a secondary cooler. The garnish is thus, stored at a cool temperature with a fresh air flow engaging the garnish overnight during storage. The integrity and quality of the garnish is also enhanced through selective regulation of the air flow over the garnish.

Figure 6A:
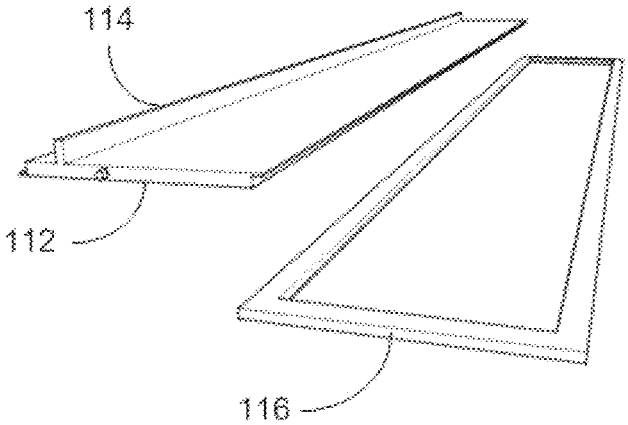
FIGS. 6A, 6B, and 6C illustrate detailed perspective view of an exemplary cooler bracket supporting the vent, where
Figure 6B:
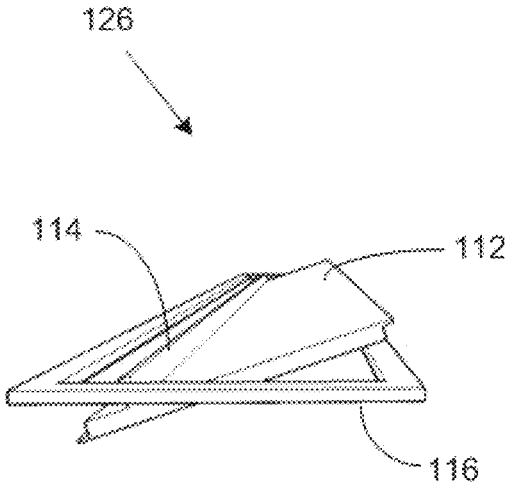
Figure 6C:
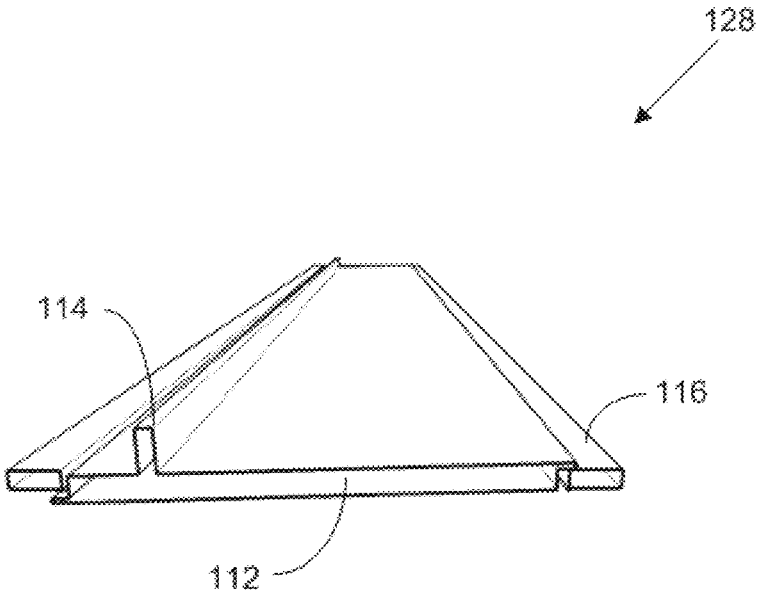

Turning now to FIG. 6A, a cooler bracket 116 is arranged around a periphery of the upper region 106. The cooler bracket 116 can include a planar trim that contours the inner periphery of the upper region 106. The cooler bracket 116 may be integrated into the cooler 102, or may detachably move between different coolers as a retrofitted component. The cooler bracket 116 forms a stable base of support for vent 112 to rest and move between the open and closed positions 126,128. In some embodiments, the cooler bracket 116 may include an inner perimeter having a pair of oppositely spaced slots. The vent 112 may have coordinating tabs that fit into the slots, such that the vent 112 can tilt as needed relative to the cooler bracket 116. In one embodiment, the vent 112 tilts at an angle to the cooler bracket 116 while in the open position 126, as referenced in FIG. 6B. In another embodiment, the vent 112 remains flush against the cooler bracket 116 while in the closed position 128, as referenced in FIG. 6C. Additionally, the cooler bracket 116 may be fabricated from an insulated material, such as foam, rubber, or wood, to help retain cool air within the cooler cavity 104. In one embodiment, the cooler bracket 116 is a ½" Styrofoam™ piece configured to fit around the periphery of a rectangular cooler.

Figure 7:
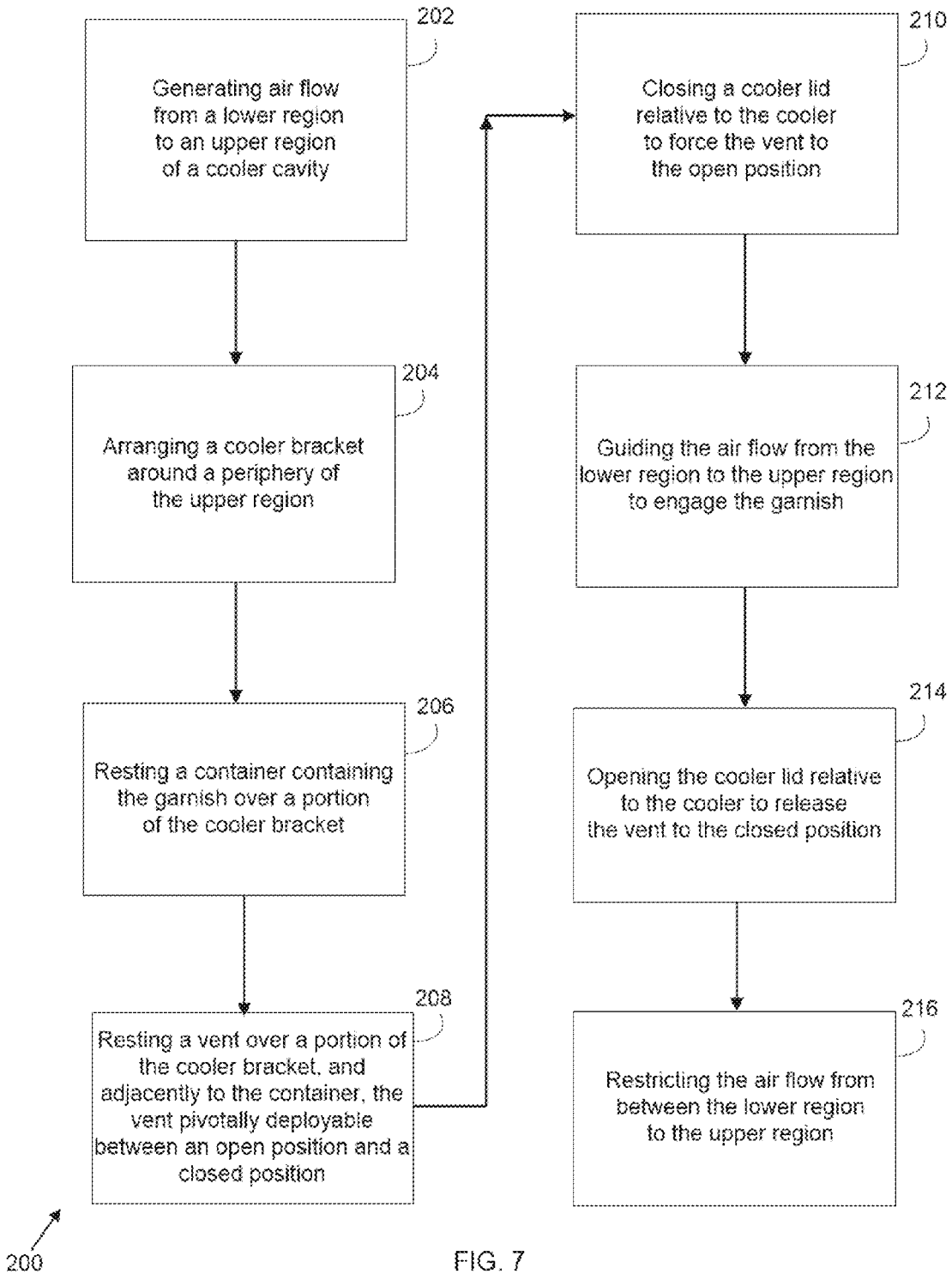
FIG. 7 illustrates a flowchart diagram of an exemplary method for regulating air flow to a garnish in a cooler, in accordance with an embodiment of the present invention.

FIG. 7 illustrates a flowchart diagram of an exemplary method 200 for regulating air flow to a garnish in a cooler 102. The method 200 is effective for maintaining freshness, crispness, and coolness to a garnish that is stored inside a cooler 102. The method 200 enables the directional regulation of air flow above and below the garnish, while keeping a desired temperature and atmosphere for the garnish inside the cooler 102. The directional movement of the air flow over the garnish is regulated by the vent 112, which moves between the open position 126 and the closed position 128. The vent 112 position is dependent on whether a cooler lid 118 is open or closed. In this manner, the method 200 selectively circulates fresh air flow above and below the garnish when the cooler lid 118 is closed, and circulates fresh air flow below the garnish when the cooler lid 118 is open.

The method 200 may include an initial Step 202 of generating air flow from a lower region 108 to an upper region 106 of a cooler cavity 104. A cooling mechanism 124 resides in the lower region 108 such that the genesis of the air flow is in the lower region 108. A fan 122 maintains a fresh circulation of the air flow in a cooler cavity 104. The fan 122, working in conjunction with the cooling mechanism 124, circulates the air flow from the lower region 108, beneath the container 110, to the upper region 106 for engagement with the garnish. The method 200 may further comprise a Step 204 of arranging a cooler bracket 116 around a periphery of the upper region 106. The cooler bracket 116 can include a planar trim that contours the inner periphery of the upper region 106. The cooler bracket 116 forms a stable base of support for vent 112 to rest and move between the open and closed positions 126,128. A Step 206 includes resting a container 110 containing the garnish over a portion of the cooler bracket 116. The container 110 is configured to position inside the cooler cavity 104 while maintaining the garnish for display and distribution. The container 110 may include an elongated, compartmentalized garnish container configured to contain a plurality of garnishes. The container 110 extends along a longitudinal axis of the upper region 106 of the cooler cavity 104.

In some embodiments, a Step 208 comprises resting a vent 112 over a portion of the cooler bracket 116, and adjacently to the container 110, the vent 112 pivotally deployable between an open position 126 and a closed position 128. The vent 112 is arranged adjacently to the container 110. The vent 112 is positioned parallel and adjacent to the container 110. In one embodiment, the vent 112 and the container 110 abut each other, forming a restrictive barrier between the lower region 108 and the upper region 106 of the cooler cavity 104. However, the vent 112 can also be pivotally deployed through manipulation of the cooler lid 118 to enable passage of the air flow between the upper and lower regions 106, 108.

A Step 210 includes closing a cooler lid 118 relative to the cooler 102 to force the vent 112 to the open position 126. A fulcrum 114 extends from the vent 112. The fulcrum 114 enables the vent 112 to pivotally deploy between an open position 126 and a closed position 128 as force is applied to one end of the vent 112. The open position 126 enables the passage of air flow communication between the lower region 108 and the upper region 106 in the cooler cavity 104 (FIG. 4). The closed position 128 restricts air flow communication between the lower region 108 and an upper region 106 in the cooler cavity 104 (FIG. 2). The hinge end 120 of the cooler lid 118 is proximal to the cooler 102 while the cooler lid 118 is opened, and engages one end of the vent 112 while closed in relation to the cooler 102. This forcible engagement causes the vent 112 to pivot on the fulcrum 114 and thus, deploy to the open position 126.

In some embodiments, a Step 212 may include guiding the air flow from the lower region 108 to the upper region 106 to engage the garnish. Through constant exposure to fresh air, the garnish can be maintained at a desired temperature and humidity overnight in the cooler 102 without requiring transfer to a secondary cooler. The garnish is thus, stored at a cool temperature with a fresh air flow engaging the garnish overnight during storage. The integrity and quality of the garnish is also enhanced through selective regulation of the air flow over the garnish. A Step 214 comprises opening the cooler lid 118 relative to the cooler 102 to release the vent 112 to the closed position 128. The closed position 128 restricts air flow communication between the lower region 108 and an upper region 106 in the cooler cavity 104. The vent 112 abuts against the container 110 while in the closed position 128, such that the air flow is restricted between the lower region 108 and the upper region 106. A final Step 216 includes restricting the air flow from between the lower region 108 to the upper region 106. The cooler lid 118 is open in this case, such that the ambient air provides fresh circulation for the garnish.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. An apparatus for regulating air flow to a garnish in a cooler, the apparatus comprising:

a container configured to contain at least one garnish in a cooler cavity having a cooler lid with a hinge end; and a vent arranged adjacently to the container, the vent pivotally deployable between an open position and a closed position, the open position configured to enable passage of air flow communication between a lower region and an upper region in the cooler cavity, the closed position configured to restrict air flow communication between lower region and an upper region, wherein the cooler lid closes in relation to the cooler to force the vent to the open position, wherein the cooler lid opens in relation to the cooler to release the vent to the closed position and, wherein the hinge end engages one end of the vent while closed in relation to the cooler, the engagement causing the vent to pivotally deploy to the open position.

2. The apparatus of claim 1, wherein the cooler is a horizontal cooler.

3. The apparatus of claim 2, further including a fan configured to generate the air flow.

4. The apparatus of claim 3, wherein the air flow is forced from the lower region towards the upper region.

5. The apparatus of claim 4, wherein the container comprises an elongated, compartmentalized container configured to contain a plurality of garnishes.

6. The apparatus of claim 5, wherein the container extends along a longitudinal axis of the upper region.

7. The apparatus of claim 6, wherein the vent comprises an elongated, planar shape that is disposed to extend along the longitudinal axis of the upper region.

8. The apparatus of claim 7, further including a cooler bracket arranged around a periphery of the upper region, the cooler bracket forming a support for the container and the vent.

9. The apparatus of claim 8, wherein the vent abuts against the container while in the closed position, such that the air flow is restricted between the lower region and the upper region.

10. The apparatus of claim 9, wherein the vent comprises a fulcrum that enables pivotal movement between the open and closed positions.

* * * * *